United States Patent [19]

Rizzardi et al.

[11] Patent Number: 4,804,114

[45] Date of Patent: Feb. 14, 1989

[54] SYRINGE FOR DOSED FILLING OF BOTTLES AND THE LIKE

[75] Inventors: Napoleone Rizzardi, Milano; Giuseppe Ripamonti, Busnago, both of Italy

[73] Assignee: Capsulit, S. P. A., Milan, Italy

[21] Appl. No.: 73,694

[22] Filed: Jul. 8, 1987

[30] Foreign Application Priority Data

Oct. 1, 1986 [IT] Italy ..... 23258/B86

[51] Int. Cl.[4] ..... B67D 1/08

[52] U.S. Cl. ..... 222/148; 137/240; 222/307; 222/309

[58] Field of Search ..... 417/518, 519, 430; 137/240, 241; 74/18.2; 222/148, 309, 387, 338, 340, 372, 307

[56] References Cited

U.S. PATENT DOCUMENTS

| | | | |
|---|---|---|---|
| 1,930,944 | 10/1933 | Schmitz | 222/372 |
| 2,354,348 | 7/1944 | Polsen et al. | 74/18.2 |
| 4,534,494 | 8/1985 | Hautemont | 222/148 |
| 4,676,279 | 6/1987 | Lersner | 137/240 |
| 4,699,297 | 10/1987 | Rague et al. | 222/148 |

FOREIGN PATENT DOCUMENTS

| | | | |
|---|---|---|---|
| 2308689 | 9/1974 | Fed. Rep. of Germany | 222/148 |

*Primary Examiner*—H. Grant Skaggs

*Attorney, Agent, or Firm*—Michael J. Striker

[57] ABSTRACT

A syringe for the measured filling of a container, such as a bottle or the like, particularly for use on rotary-head filling machines, of the type including a valve means (11) having a cylinder body and arranged to selectively communicate an inlet conduit (5) and an outlet conduit (6) with a cylinder chamber (2) in which a double-acting piston (7) is slidably received, wherein during the cleaning and/or sterilizing of the syringe, both said valve means (11) and piston (7) are positioned within a widening (4) in the cylinder chamber (2) such that pressurized liquid or steam from the inlet conduit (5) will impinge upon and sweep all over the inner wall of cylinder chamber (2), the surface of the valve (11), the piston (7) and the associated portion of piston rod (8) extending inside the cylinder (2), with liquid or steam also flowing through a valve passage (12) in valve means (11).

7 Claims, 2 Drawing Sheets

SYRINGE FOR DOSED FILLING OF BOTTLES AND THE LIKE

This invention relates to a syringe for dosed filling of bottles or the like, particularly for use on rotary head filling machines, which syringe can be sterilized in situ throughout its parts in a simple manner, without the syringe having to be removed from the filling machine on which it is mounted.

In a known manner, a syringe for the measured filling of containers has inlet and outlet conduits which can be selectively communicated with an inner chamber of a double acting cylinder through a valve means. In this cylinder, a piston is slidably received in a liquid-tight manner and, in a first stage, the piston causes a liquid to be drawn in from the inlet conduit, while in a next stage, the drawn in liquid is discharged by the piston into a container via the outlet conduit.

Since this tpye of syringe is normally used for handling medicinal substances, a frequent sterilization thereof is required.

In filling machines of an older type, cleaning and sterilizing of the circuit have involved complicated operations for removing a syringe from the machine and then mounting it again thereon.

A first advance toward sterilization "in situ" was achieved on inline machines where the syringes are mounted in a fixed manner and, thus, better suited for cleaning and sterilizing them while being in place.

Rotary machines have also been proposed—which the invention is particularly but not exclusively related to—wherein the circuit can be cleaned and/or sterilized without requiring removal of the syringe.

However, these machines are suffering from a number of disadvantages, among which, in a first place, the fact that not all the parts of the circuit and the syringe are capable of being completely discharged of the handled product and/or contacted with the cleaning liquid and/or the steam, as a result of which the cleaning or sterilizing operations are never carried out thoroughly. Thus, for example, the piston rod which, in spite of its sealing system, is liable to contamination, is not impinged upon by the sterilizing fluid.

The object of this invention is to obviate the above disadvantages by providing a syringe that can be easily sterilized in all of its parts, including the bottom part and the piston rod, without requiring the syringe to be removed from the machine.

According to the invention, a syringe for the dosed filling of containers, of the type as state above, is characterized in that, during the cleaning or sterilizing of the syringe, both its valve and piston means are positioned in a widened recess in the cylinder so as to have all the parts of the circuit, including the piston rod, exposed to the action of a cleaning liquid or the sterilizing steam.

Figure 1:
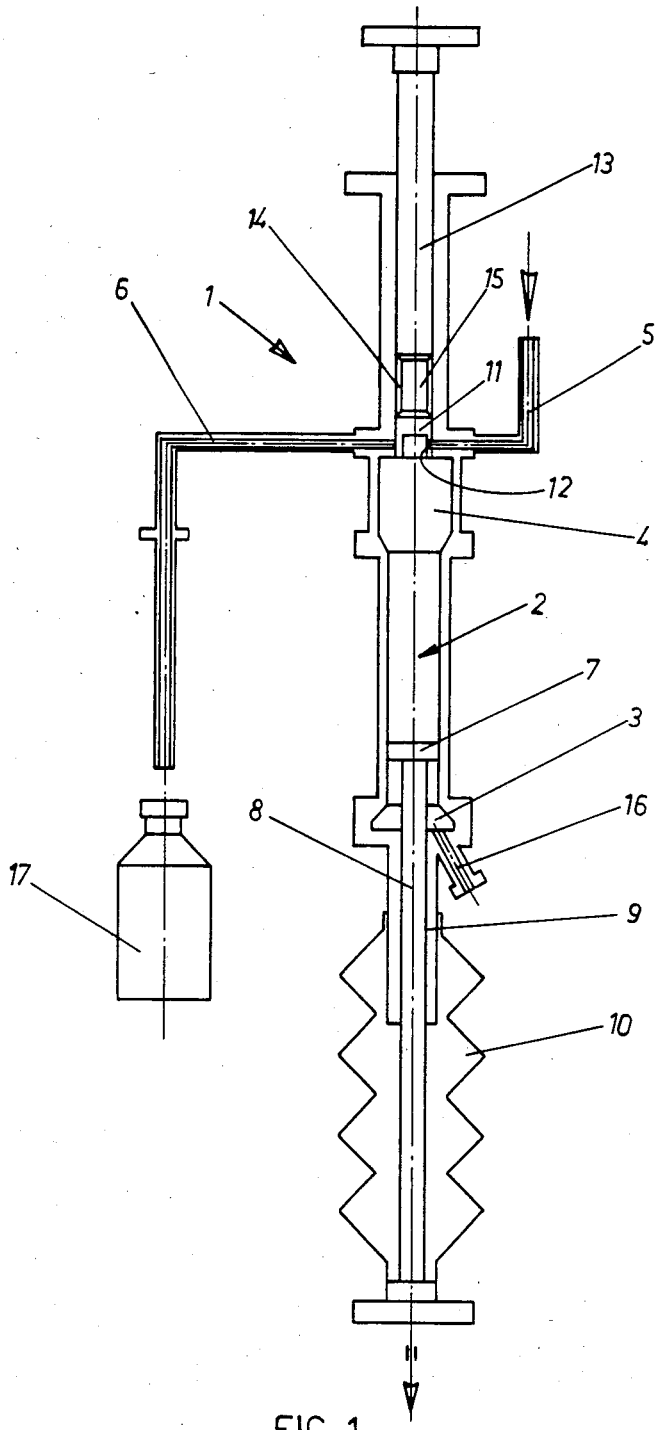
Figure 2:
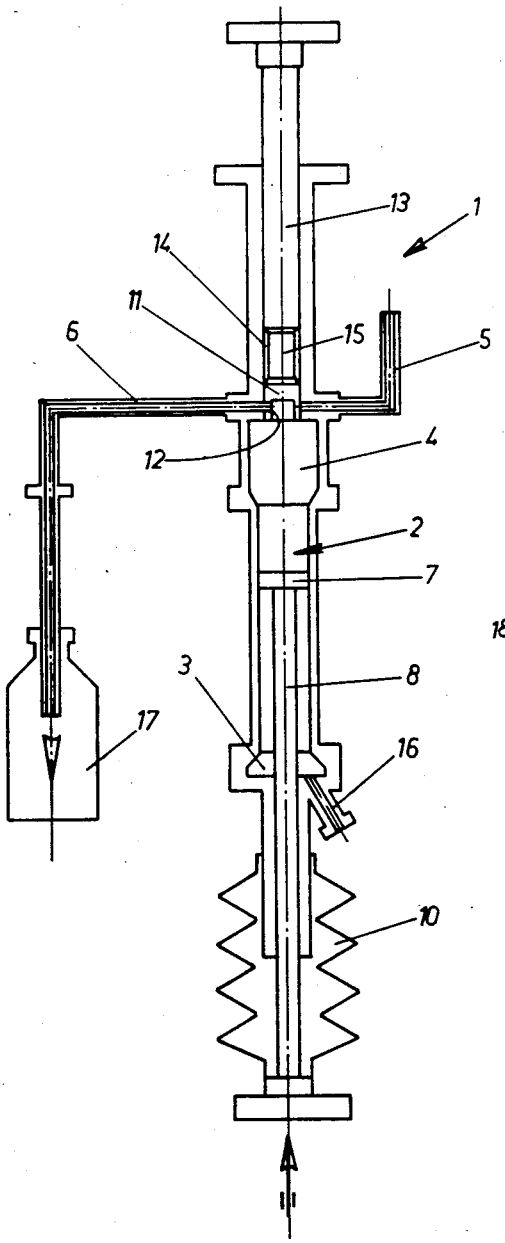
Figure 3:
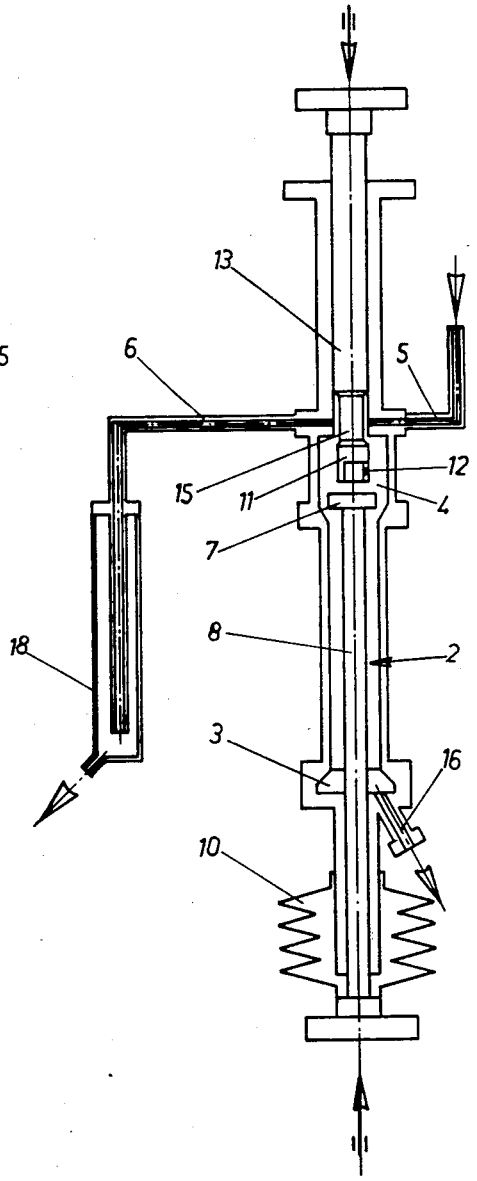

The above and further features and advantages of the syringe according to this invention will be better understood when reading the following detailed description of one preferred embodiment thereof which is shown by way of a non-limiting example by the accompanying drawings, in which:

FIGS. 1 and 2 are middle cross-sectional views showing a syringe according to the invention in two different stages of its operating cycle, and FIG. 3 is a similar view of the same syringe when in a cleaning or sterilizing position.

Referring now to the above figures, a syringe according to the invention is generally shown therein by reference numeral 1. This syringe is particularly suitable for application on filling machines of the rotary-head type on which machine the mounted syringe can be easily sterilized in all of its parts without requiring removal from the machine utilizing it, as will be seen further.

The syringe 1 includes an inner cylinder chamber 2 having a bottom widening 3 and a top widening 4 of greater size which communicates with both an inlet conduit 5 and an outlet conduit 6 being diametrally opposed to one another.

Slidably received in the cylinder 2 is a double-acting piston 7 the piston rod 8 of which extends through a bore 9 out of the cylinder bottom. The out-extending portion of piston rod 8 has a protective means 10 provided around it for protection against dust entrance, the protective means 10 being for example in the form of a bellows made of a flexible material or the like. Obviously, the arrangement also includes packing means not shown in the schematic drawings. The inlet and outlet conduits 5 and 6 are controlled during operation in a selective manner by a valve means 11 having a cylindrical valve head in which a passage 12 is formed and communicates with the cylinder chamber 2.

The valve head 11 is carried at the lower end of a valve stem 13 having a portion 15 of reduced diameter adjacent the valve head 11. The valve stem 13 extends through, and—by its upper end—out of a bore 14 which is coaxial to both the cylinder chamber 2 and the lower bore 9 through which the piston rod 8 of piston 7 extends. The bottom widening 3 in cylinder 2 is in communication with the exterior via a conduit 16 permitting the cylinder chamber to be drained off during a cleaning or sterilizing operation. Before describing the cleaning and/or sterilizing of the syringe, a brief description of operation of this latter, when in working condition, is given below.

Starting from the position in FIG. 1, and assuming the piston 7 as being at its top dead center position, such as shown, for example, in FIG. 2, then, the passage 12 in valve 11 is in open communication with the liquid inlet conduit 5 and liquid is permitted to be drawn in by the piston 7 when this latter is moved down to its bottom dead center position, such as viewed, for example, in FIG. 1. When the piston 7 reverses its stroke, the valve 11 rotates by 90° or 180° to put the valve passage 12 in flowing communication with the outlet conduit 6, as shown in FIG. 2, so that on upward movement of piston 7 the liquid in cylinder chamber 2 is caused to flow out of conduit 6 thereby to fill a container 17 placed at the discharge end of same conduit 6. When the piston again reaches its top dead center position, the valve 11 is further rotated by 90° or 180° to put the valve passage 12 in flowing communication with the inlet 5 whereupon a new cycle can be started.

As it should be apparent, the measured quantity of liquid to be filled in container 17 is controlled by adjusting the stroke of piston 7.

In order to effect cleaning and/or sterilizing of the syringe, both the valve 11 and piston 7 are caused, by oppositely directed movements imparted on them, to gain a position inside the widening 4 in cylinder 2, as shown FIG. 3. In this position, the bottom conduit 16 permits any liquid still retained in cylinder chamber 2 to be drained off, while the reduced diameter portion 15 of stem 13 of valve 11, which portion 15 has moved to a position facing the openings to conduits 5 and 6, enables liquid and/or steam to be admitted and expelled, respectively, therethrough.

Then, both the outlet conduit 6 and discharge conduit 16 are connected to drain spouts while pressurized steam is admitted to inlet conduit 5.

As it can be seen, FIG. 3, steam entering the cylinder chamber 2 first impinges upon the reduced diameter portion 15 of stem 13 of valve 11 and the valve itself, it also flows through the valve passage 12 and it sweeps all over the inner surface of the cylinder, as well as the surface of piston 7 and that of the associated portion of piston rod 8 extending inside the cylinder, to be then discharged through the outlet conduits 16 and 6, which latter is also sterilized over its outer end portion due to the presence of a spout 18 surrounding said end portion as viewed FIG. 3.

Thus, a thoroughly performed sterilization is ensured for all the internal parts of the syringe, namely the parts of the syringe that are normally in contact with the handled liquid, as well as those parts thereof, such for example as the piston rod 8 of piston 7, which could accidentally be contacted by that liquid.

It should be apparent that the invention is not limited to the particular embodiment thereof described herein above and shown by the accompanying drawings, and many changes as to the details of construction may be made thereto without departing from the spirit and scope of the invention as defined by the appended claims.

We claim:

1. A syringe for dosed filling of a container, comprising:

a body defining a chamber (2) with an inner wall;

valve means for selectively communicating said chamber (2) with an inlet conduit (5) and an outlet conduit (6), said valve means including a valve head (11) with a passage (12) therein;

a double-acting piston slideably received in said chamber (2), said piston having a piston head (7) and a piston rod (8) extending from said piston head (7); and means for facilitating a pressurized fluid flowing from said inlet conduit (5) to impinge upon and sweep over said inner wall of said chamber (2), said valve head (11), said piston head (7) and a portion of said piston rod (8) extending in said chamber (2), said facilitating means including a widening (4) of said chamber (2) formed to simultaneously accomodate both of said piston head (7) and said valve head (11) therein and thereby assist in facilitating a cleaning and sterilizing of the syringe by the pressurized fluid, both said piston head (7) and said valve head (11) being movable towards and away from each other to move respectively into and out of said widening (4).

2. The syringe as defined in claim 1, wherein said valve means includes a valve stem (13) supporting said valve head (11) so that said valve head (11) moves together with said valve stem (13), said valve stem (13) having a stem portion (15) with a reduced diameter adjacent to said valve head (11) so that the pressurized fluid flows into and out of said chamber (2) when said stem portion (10) is between the inlet conduit (5) and the outlet conduit (6) and said valve head (11) is in said widened portion (4).

3. The syringe as defined in claim 2; and further comprising:

means for moving said valve stem (13) so as to position said valve head (11) into said widening (4).

4. The syringe as defined in claim 1; and further comprising:

the outlet conduit (6) with an end portion having an outer surface, said facilitating means also being formed to facilitate impingement by the pressurized fluid on said outer surface; and a discharge spout (18) around said end portion.

5. The syringe as defined in claim 1, wherein said piston rod (8) of said piston (7) has an end portion extending out of said chamber (2); and further comprising:

means for protectively covering said end portion and including a bellows (10) around said end portion and composed of flexible material.

6. The syringe as defined in claim 1, wherein said passage (12) of said valve head communicates with said chamber (2), said valve head being rotatable to selectively communicate said passage (12) with the inlet conduit (15) and the outlet conduit (6).

7. The syringe as defined in claim 1, wherein said chamber has a cylindrical shape.

* * * * *